US006971767B2

(12) United States Patent
Agabekov et al.

(10) Patent No.: US 6,971,767 B2
(45) Date of Patent: Dec. 6, 2005

(54) LIGHTING ELEMENT AND LIGHTING FIXTURE FITTED WITH SAID ELEMENT

(76) Inventors: Ladislav Agabekov, route de thonon 73, Vesenaz (CH) 1222; Ivan Agabekov, 14, boulevard Saint-Georges, Geneva (CH) 1204

( * ) Notice: Subject to any disclaimer, the term of this patent is extended or adjusted under 35 U.S.C. 154(b) by 0 days.

(21) Appl. No.: 10/469,638

(22) PCT Filed: Aug. 6, 2001

(86) PCT No.: PCT/CH01/00478

§ 371 (c)(1),
(2), (4) Date: Sep. 3, 2003

(87) PCT Pub. No.: WO02/079688

PCT Pub. Date: Oct. 10, 2002

(65) Prior Publication Data

US 2004/0070991 A1 Apr. 15, 2004

(30) Foreign Application Priority Data

Apr. 2, 2001 (CH) ..... 618/01

(51) Int. Cl.[7] ..... F21Y 101/02
(52) U.S. Cl. ..... 362/249; 362/247; 362/225; 362/219; 362/297

(58) Field of Search ..... 362/543–545, 362/516, 297, 341, 249, 235, 247, 217, 225, 362/219

(56) References Cited

U.S. PATENT DOCUMENTS

| | | | | |
|---|---|---|---|---|
| 5,655,830 | A | 8/1997 | Ruskouski | 362/240 |
| 5,726,535 | A | 3/1998 | Yan | 315/185 R |
| 6,641,284 | B2 * | 11/2003 | Stopa et al. | 362/240 |
| 6,726,502 | B1 * | 4/2004 | Hayes | 439/422 |
| 6,805,470 | B1 * | 10/2004 | Ward | 362/374 |

FOREIGN PATENT DOCUMENTS

WO 01 07828 2/2001

* cited by examiner

*Primary Examiner*—Laura K. Tso
(74) *Attorney, Agent, or Firm*—Ostrolenk, Faber, Gerb & Soffen, LLP

(57) ABSTRACT

The invention relates to a lighting element comprising an insulating plate (2) and two rows of LEDs (3, 4) which are fixed to the top and bottom of said plate. The LEDs are connected in series or/in parallel and both ends of said plate are provided with electrical contacts (5, 6) which are connected to the LED branches and which are intended to be fixed to the electrical supply terminals (9, 10).

16 Claims, 3 Drawing Sheets

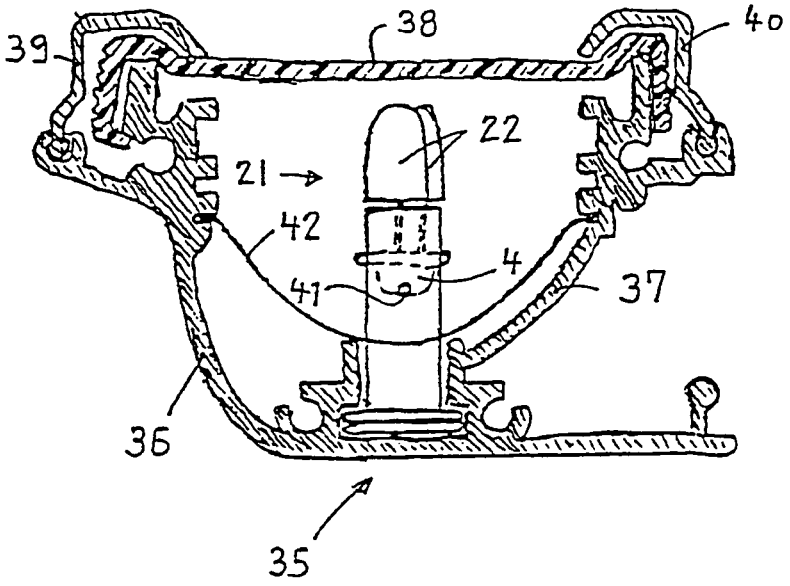
Fig. 7
Fig. 8
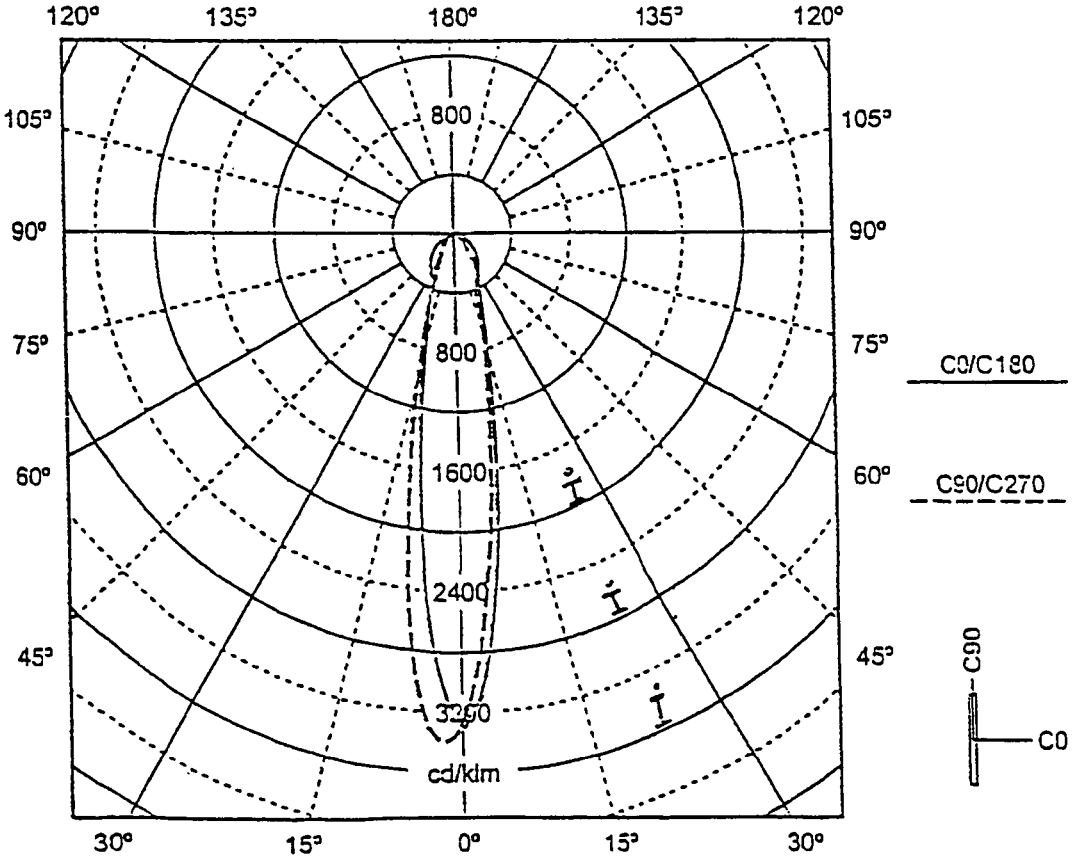

LIGHTING ELEMENT AND LIGHTING FIXTURE FITTED WITH SAID ELEMENT

BACKGROUND OF THE INVENTION

The object of the invention is a lighting element. A further object of the invention is a lighting fixture fitted with such element(s).

The term lighting element encompasses all incandescent bulbs, neon tubes, sodium bulbs, Xenon bulbs, etc. White lights for lighting can have low colour content usually bordering on red, yellow, and even blue. However, for lighting, it is vital that an element of this type provides significant white light content.

Approximately twenty years ago, new light sources known as LEDs appeared on the market. These LEDs, which are not usually very bright, are used for lighting on roads, walls or signposts. This lighting and signage function is usually achieved with coloured LEDs, namely red, blue, green, yellow, etc. LEDs. This lighting is carried out to indicate routes or obstacles and has low luminous intensity, to prevent dazzling. Unlike bulbs of all sorts, the LEDs used for lighting offer the great advantage of having an extremely long lifetime, in the order of 100,000 hours of use. This long lifetime is a significant advantage, as it is no longer necessary to change or replace faulty lamps or bulbs.

The purpose of this invention is to propose a lighting element, and therefore an element emitting white light with this long operational life, and this lighting element can be advantageously used in a lighting fixture fitted with one or more pairs of electrical supply terminals evenly distributed inside, along the lighting fixture. These lighting strip fixtures are generally sued to provide surface lighting over long lengths and are made up of units that can be up to 6 meters long which, when placed one after another, allow for long lengths to be lit, for example ceilings, walls, etc. The lighting strips, which are particularly suited to receiving the lighting elements that are the object of this invention, are described in European patent no. 652398 or in PCT/CH97/003 17, such patent and PCT patent belonging to Agabekov group, which is also the holder of this patent. The electrical supply to the lighting strips mentioned above is obtained through electrical supply tracks, also protected by European patents no. 375 623 and 516 578, also in the name of the Agabekov group. These electrical supply tracks are slid inside the lighting strips and have pairs of supply terminals placed one after another at equal distances along the track. The lighting elements that are the object of this invention are advantageously placed along the tracks between the pairs of supply terminals. It can immediately be seen that, once the strip is installed and fitted with the lighting elements according to the invention, it will have a very long lifetime and no further maintenance will be necessary.

SUMMARY OF THE INVENTION

The lighting elemenaccording to the invention is characterised in that it has an insulating plate, to which are fastened LEDs connected in series and/or in parallel, the plate having electrical contacts at each end, connected to the branch of LEDs and designed to be connected to electrical supply terminals.

The lighting element according to the invention will advantageously have an insulating plate in the form of a printed circuit board, the LEDs being soldered onto the conductive supply lines of the plate producing branches in series and/or in parallel, the conductive lines being attached to the electrical contacts at each end of the plate.

In a preferred embodiment, the LEDs will be arranged above and below the insulating plate.

The electrical contacts can be made in the form of festoon bulb contacts or in the form of rigid loops.

In a preferred embodiment, the plate has 6 LEDs connected in series and powered by a 50 mA current at 24 volts.

The lighting element will advantageously have 6 LEDs placed above the plate and 6 LEDs placed below it, each row of 6 LEDs being powered by a 24 volt current.

All of the LEDs connected to the lighting element according to the invention will emit a light with high white content.

The lighting element according to the invention will be advantageously used in a lighting fixture or a lighting strip fitted with pairs of electrical supply terminals placed one after another at equal distances along the strip. The lighting fixture that is the object of the invention has a long, thin frame, an electrical supply track and a parabolic reflector, both of which are placed at the bottom of the lighting fixture, and is characterised in that the track is fitted with a lighting element comprising an insulating plate on which LEDs connected in series and/or in parallel are fixed, the plate having electrical contacts at each end designed to be connected to lighting fixture electrical supply terminals, the lighting element being placed at the centre of the surface of the parabolic reflector.

BRIEF DESCRIPTION OF THE DRAWINGS

The drawing shows, as an example, an embodiment and versions of the lighting element according to the invention, together with views of the track using such element.

FIG. 7 is a copy of a version of a lighting strip holding a track fitted with a succession of the elements in FIG. 4 and FIG. 8 is a representation of the distribution of the luminous intensities as a polar diagram obtained with the lighting strip shown in FIG. 7.

DESCRIPTION OF PREFERRED EMBODIMENTS

Figure 2:
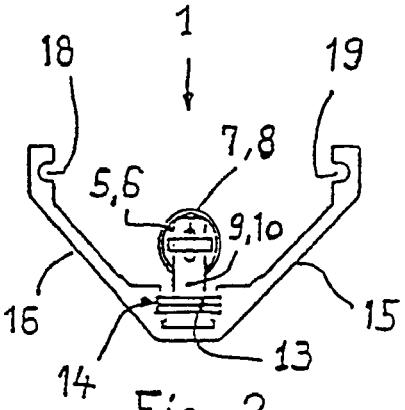
FIG. 2 is a front view of the lighting element in FIG. 1, placed on an electrical supply track slid inside a lighting strip.

The embodiment of the lighting element shown in FIG. 1 has a printed circuit plate 2, on which are placed two rows of 6 LEDs, 3 and 4 respectively, above and below the plate. These LEDs 3 and 4 are connected in series to conductive parts, not shown, on the plate, connected at each end to circular contacts 5, 6, identical to the contacts normally used with festoon bulbs. The contacts 5 and 6 (see also FIGS. 2 and 3) inserted into holes 7 and 8 respectively, made in electrical supply terminals 9, 10, connected to insulated conductors 11, 12, forming an electrical supply track 13 of the same type as the electrical supply tracks described in European patents no. 375 123 or 516 578. These tracks allow for a succession of lighting elements to be powered and are designed to be inserted into a groove 14 in a lighting strip 15. At least one groove 18, 19 is placed on the upper edge of the wings 16 and 17. This groove is designed to receive a reflector, not shown, and/or protective glass. The lighting strip or lighting fixture shown in FIGS. 2 and 3 is a strip similar to the strip described in European patent no. 561 398 or in PCT97/003 13, also in the holder's name.

Figure 1:
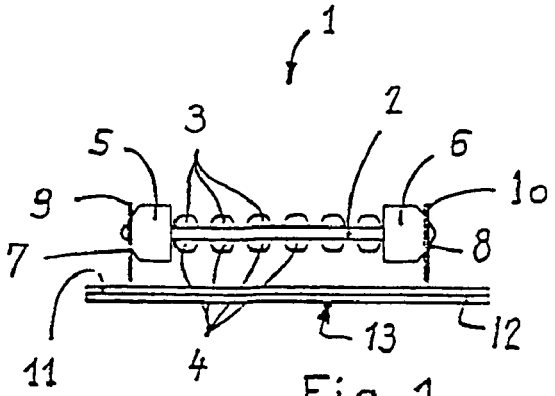
FIG. 1 is a side view of a first embodiment of a lighting element.
Figure 3:
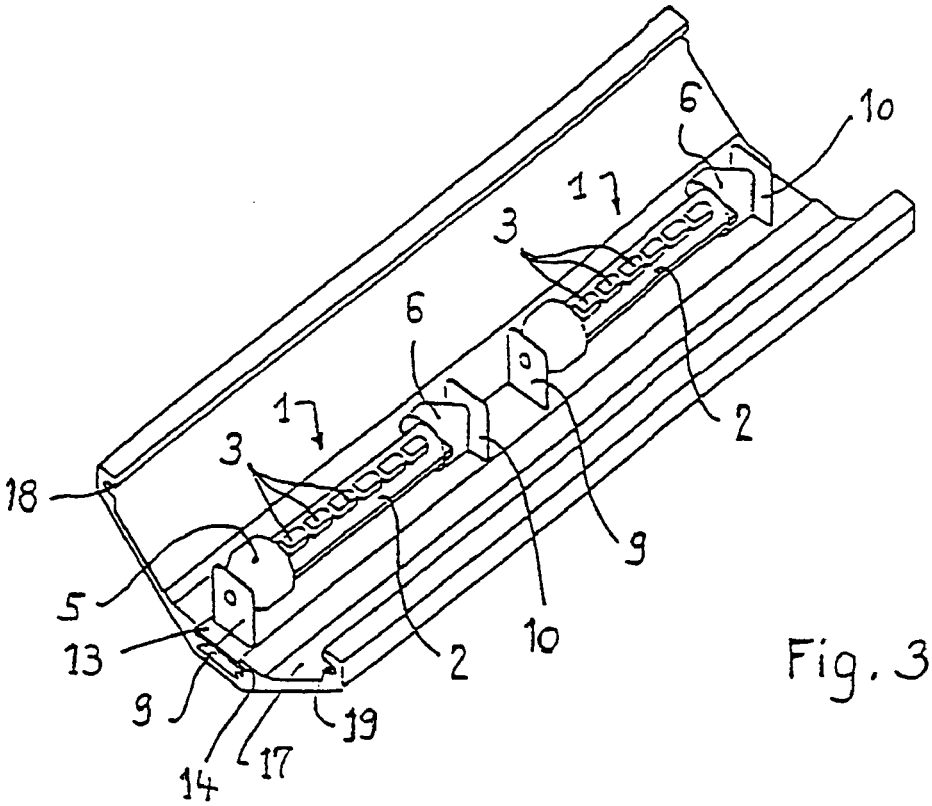
FIG. 3 is a perspective view of a portion of the lighting strip in FIG. 2, such portion having 2 lighting elements.
Figure 5:
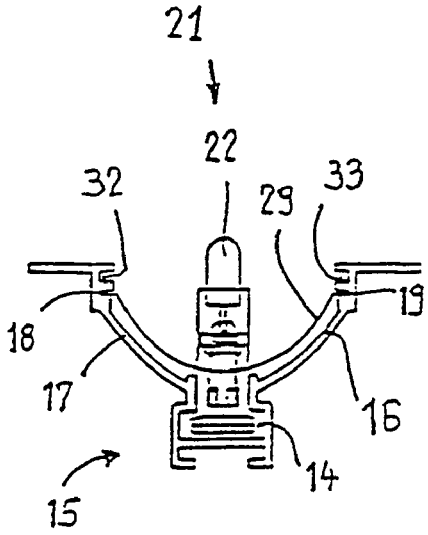
FIG. 5 is a front view of the lighting element in FIG. 4 mounted in a lighting strip fitted with a reflector.

The LEDs shown in the embodiment in FIGS. 1 to 3 are NICHIA SMD 120°/60° 00.66 cd LEDs and are designed to be powered at 4 volts per unit. The element 1 in FIGS. 1 to 3 will therefore be supplied with 24 volts, which corresponds to a voltage normally used in lighting strips of the type shown in FIGS. 2 and 3. Given the diodes used, approximately 50 mA of current will pass through the element. The LEDs, the specifications of which are given above, emit a white light and if the lighting element has an upper row of 6 LEDs and a lower row also of 6 LEDs, and a parabolic reflector has been placed in the lighting strip, the luminosity per unit of length supplied by the strip is entirely satisfactory.

Figure 4:
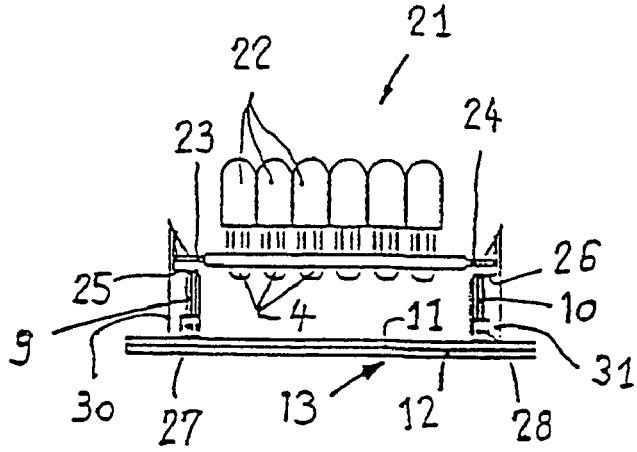
FIG. 4 is a side view of a version of the embodiment of the electrical supply track in FIG. 1, the track containing a lighting element.
Figure 6:
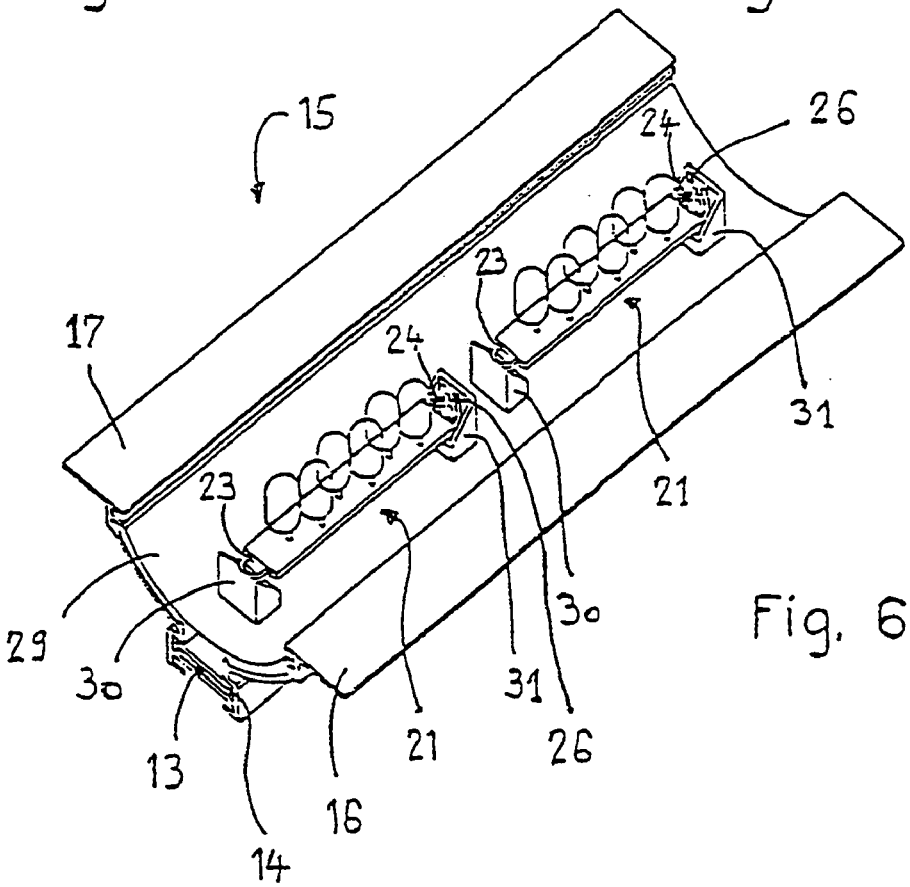
FIG. 6 is a perspective view of a portion of the lighting strip in FIG. 5 fitted with the elements shown in FIG. 4.

In the version shown in FIG. 4, the lighting element 21 has, as does the element in FIG. 1, a printed circuit plate 2, on which two rows of 6 LEDs are mounted, 22 and 4 respectively, the LEDs 22 and 4 being placed above and below the plate 2. The LEDs 4 are of the same type described in relation to FIG. 1 and are NICHIA SMD 120°/60° 0.66 cd LEDs connected in series to conductive supply lines, not shown, on the plate 2, and NICHIA 5 mm diameter 5.6 cd/20° LEDs. As in the embodiment in FIGS. 1 to 3, these LEDs are connected to conductive parts of the plate each connected at their ends to contacts, 23, 24 in the form of a loop. The contacts 23, 24 in the form of a loop are clipped onto carriers 25, 26, which themselves are located by friction on the electrical supply terminals 9, 10 by means of frames 27, 28. The carriers 25, 26, with their upper part in the shape of a clip designed to receive the loops and their frames 28, are described in detail in European patent no. 516 578 and the electrical supply terminals 9, 10 are the same as in the embodiment in FIGS. 1 to 3 connected to insulated conductors 11, 12 forming the electrical supply track. The supply track 13 is also described in European patent 516 578 and is designed to power a succession of lighting elements placed along the track 13. The carriers 26, like the electrical supply terminals 9, 10 that support them, pass through a parabolic reflector 29 slid into the grooves 18 and 19 in the wings 16 and 17 in a lighting strip 15 similar to the lighting strip in the embodiment in FIGS. 1 to 3. The insulating track 13 is inserted in a groove 14 in the lighting strip with the parabolic reflector 29 held laterally in grooves 18 and 19 in the wings 16 and 17 of the lighting strip. The lighting strip 15 is, like the lighting strip in the embodiment in FIGS. 1 to 3, very similar to the lighting strip described in European patent no. 651 398 or in PCT 97/00313. Finally, the carriers 25 and 26 mounted on the electrical supply terminals 9 and 10 are surrounded by protective insulating sheaths 30 and 31, which also pass through the parabolic reflector 29. The electrical supply track in FIGS. 4 and 6 has, in the upper part of the wings 16 and 17, a groove 32, 33, designed to receive a filter or protective glass.

As in the embodiment in FIG. 1 to 3, the lighting elements 1 and 21 are positioned in such a way that they are placed in the center of the parabolic surface of the reflector. This thus provides a maximum reflection rate and a large reflected beam.

In the version in figure 7, the lighting fixture or lighting strip shown as a cross section is made from an extruded section 35 with two lateral wings 36 and 37. A transparent plastic cover, 38, is placed at the tip of the lateral wings 36 and 37, and is gripped onto the upper edges of the wings by positioning sliders 39, 40. Covers, not shown, are placed at the free ends of the section, designed to enclose the lighting fixture, which will not be described in detail, in a watertight manner. This lighting fixture is the object of the PCT patent published under no. 97/00313 and has been used to date with conventional lighting elements, particularly festoon lamps or Xenon lamps. In the version shown in FIG. 7, the lighting fixture is fitted with lighting elements 21 identical to the element in FIG. 4. These elements 21 have six direct lighting LEDs 22 above the plate with a narrow 20° beam. Below the plate, the element 21 has six LEDs 4 with a wide light beam at 60° and 120° respectively. The element is positioned in the lighting fixture 35 along orthogonal coordinates as shown in the drawing, so that the LEDs are placed at the center 41 of the parabolic reflector 42. Thus, the wide light beam emitted by the LEDs is reflected upwards along a vertical component by the reflector 42 and all of the light emitted and reflected is added to the direct beam emitted by the LEDs 22. The result obtained with the elements 21 placed in the lighting fitting 35 is entirely unexpected and the light provided by the lighting fixture is sufficient to light surfaces, such as walls, ceilings, etc. This fact was not obvious, as the luminous intensity of LEDs is relatively low relative to conventional bulbs.

Measurements were taken with a "Neptune" lighting fixture such as the one shown in cross section in FIG. 7. This lighting fixture is 0.875 m long, 0.070 m wide and 0.040 m high. The horizontal illuminating surface was 0.835 m long and 0.035 m wide.

This lighting fixture contained 15 elements of two times six LEDs for a power of 18 Watts and a total flux in lumens of around 1,000.

As already mentioned, the six LEDs placed on the upper part of the element plate are NICHIA 5 mm diameter 5.6 cd/20° LEDs, and the six LEDs placed on the lower part of the element plate are NICHIA SMD 120°/60° 0.66 cd LEDs. Each element is powered with 24V DC.

FIG. 8 shows a graph showing the distribution of the luminous intensity I in a polar diagram for a direction along the axis of the lighting fixture, C90/C270, and a direction perpendicular to this axis, C0/C180.

As already mentioned, the results obtained with the lighting element described above are excellent and the lighting fixture offers the advantage of an extremely long lifetime for maintenance. It can be advantageously used in a lighting fixture or lighting strip as described in PCT CH 97 00317 in order to light large areas (wall, ceiling, floor) with a narrow, concentrated light beam without light loss.

As shown in the drawings, the embodiment and version of the lighting element are used advantageously in a lighting strip. The 1 m lighting strip 21 will therefore be sized to present a long and relatively thin configuration. However, the invention is not limited to the elements described in the drawing and the lighting element may be changed significantly. If a reflector is used, the plate 2 will be advantageously fitted with LEDs on two sides. Obviously, a curved plate or a plate with a triangular or square section can be used. In this case, three or four rows of LEDs are obtained. Moreover, a much longer plate can be envisaged, with rows with a much larger number of LEDs powered by approximately 4 volts per unit or another voltage depending on the specifications of the LEDs used. As already mentioned, the lighting element described above has the advantage of a very long lifetime. In these circumstances, when it is used in very long electrical supply tracks or banks located in places that are hard to access, it offers a very significant advantage due to its long lifetime. Moreover, it uses less power than conventional bulbs.

What is claimed is:

1. A lighting element comprising an insulating plate onto which a plurality of LEDs connected at least one of in series and in parallel are mounted, the plate having ends, electrical contacts at each end of the plate connected to the plurality of LEDs and adapted to be connected to electrical supply terminals wherein the LEDs are arranged both above and below the insulating plate;

the LEDs below the plate emit a light beam with a larger beam angle; and the LEDs above the plate are direct lighting LEDs forming a light beam with a smaller beam angle.

2. The lighting element according to claim 1, wherein the insulating plate is a printed circuit board having conductive supply lines, the LEDs being soldered onto the conductive supply lines of the plate forming connections in the respective one of series and in parallel, and the conductive supply lines attached to the electrical contacts at each end of the plate.

3. The lighting element according to claim 2, wherein the electrical contacts are rigid loops.

4. The lighting element according to claim 1, wherein the plate has six of the LEDs connected in series and powered by 24 Volts.

5. The lighting element according to claim 1, wherein the plate has six of the LEDs in a first row placed above the plate and six of the LEDs in a second row placed below the plate, each of the rows being powered by 24 Volts.

6. The lighting element according to claim 1, wherein the LEDs are 120°/60°, 0.66 cd LEDs.

7. The lighting element according to claim 1, wherein the LEDs are 5 mm 15 diameter 5.6 cd/20° LEDs.

8. The lighting element according to claim 1, wherein the LEDs emit a light with high white content.

9. The lighting element according to claim 1, wherein the LEDs below the plate have a beam angle, of at least 60°.

10. The lighting element according to claim 9, wherein the LEDs above the plate form a light beam with a beam angle of 20°.

11. The lighting element according to claim 9, wherein the first row of LEDs placed above the plate are LEDs with a light beam with a small beam angle, and the second row of LEDs placed below the plate are LEDs with a large beam angle.

12. The lighting element according to claim 11, wherein the first row of LEDs placed above the plate are 5 mm diameter 5.6 cd/20° LEDs, whilst and the second row of LEDs placed under the plate are 120°/60°, 0.66 cd LEDs.

13. A lighting element comprising an insulating plate onto which a plurality of LEDs connected at least one of in series and in parallel are mounted, the plate having ends and electrical contacts at each end connected to the plurality of LEDs and adapted to be connected to electrical supply terminals wherein the electrical contacts are festoon bulb contacts.

14. A lighting fixture or lighting strip comprising:

a long, thin frame; an electrical supply track and a parabolic reflector having a surface, the track and the reflector both placed at a bottom of the lightinn fixture;

the track being fitted with a lighting element comprising an insulating plate onto which a plurality of LEDs connected at least one of in series and in parallel are mounted, the plate having ends and electrical contacts at each end adapted to be connected to lighting fixture electrical supply terminals, the lighting element being positioned at the center of the surface of the parabolic reflector; and the lighting element includes direct lighting narrow beam LEDs placed above the plate and indirect lighting wide light beam LEDs, the wide light beam LEDs being positioned at the center of the parabola forming the reflector.

15. Lighting fixture according to claim 14, further comprising the electrical supply track having sets of pairs of the electrical supply terminals, placed at equal distances from each other along the track, and one of the lighting elements being placed between each pair of terminals.

16. A lighting fixture or lighting strip comprising:

a long, thin frame; an electrical supply track and a parabolic reflector having a surface, the track and the reflector both placed at a bottom of the lighting fixture;

the track being fitted with a lighting element comprising an insulating plate onto which a plurality of LEDs connected at least one of in series and in parallel are mounted, the plate having ends and electrical contacts at each end adapted to be connected to lighting fixture electrical supply terminals, the lighting element being positioned at the center of the surface of the parabolic reflector;

the electrical supply track having sets of pairs of the electrical supply terminals, placed at equal distances from each other along the track, and one of the lighting elements being placed between each of the pairs of terminals; and each lighting element comprises a plurality of direct lighting ones of the LEDs with an angle of 20° placed above the plate and a plurality of the LEDs with a large angle of 60° to 120° placed below the plate.

* * * * *